United States Patent [19]

Frazzitta

[11] Patent Number: 4,779,557

[45] Date of Patent: Oct. 25, 1988

[54] COATER FOR A SHEET FED PRINTING PRESS

[76] Inventor: Joseph Frazzitta, 279 Cherry Pl., East Meadow, N.Y. 11554

[21] Appl. No.: 77,699

[22] Filed: Jul. 27, 1987

Related U.S. Application Data

[63] Continuation-in-part of Ser. No. 902,782, Dec. 4, 1986, abandoned, which is a continuation of Ser. No. 748,974, Jun. 26, 1985, abandoned.

[51] Int. Cl.[4] ..... B05C 1/02

[52] U.S. Cl. ..... 118/46; 118/224; 118/249; 118/262

[58] Field of Search ..... 118/46, 224, 249, 262; 101/419; 427/428

[56] References Cited

U.S. PATENT DOCUMENTS 4,046,931 9/1977 Innes et al. ..... 118/262 X 4,270,483 6/1981 Butler et al. ..... 118/46

4,347,269 8/1982 Keep ..... 118/249 X 4,399,767 8/1983 Simeth ..... 118/249 X

*Primary Examiner*—Evan K. Lawrence

[57] ABSTRACT

A coater for an offset printing press in which the last printing station, i.e., the blanket cylinder roller with its associated sheet-handling grippers, is converted to coating service, such that a pick-up roller, after an ascending arcuate path not exceeding 80°, transfers a liquid coating to an applicator roller rotating in an opposing direction to the blanket cylinder surface which coats the individual imprinted sheets and the liquid coating itself serves as a lubricant permitting said opposing directions of rotation and grippers of said blanket cylinder roller maintain proper handling control of the sheets during the coating thereof. Limiting the arcuate path of 80° obviates reverse flow of the liquid coating on the pick-up roller.

4 Claims, 3 Drawing Sheets

COATER FOR A SHEET FED PRINTING PRESS

This is a continuation-in-part of application Ser. No. 902,782, filed Dec. 4, 1986, now abandoned, which is a continuation of application Ser. No. 748,974, filed June 26, 1985, now abandoned.

The present invention relates to improvements in coating individual sheets during the printing thereof in an offset printing press, and more particularly to a coating device for an offset printing press that effectively applies a aqueous, ultra-violet or other liquid coating to each imprinted sheet, in turn, without adversely affecting the printing operation of the printing press.

Applying liquid coating to printed material is, of course, already well known, and achieved using coating devices of well-known construction and modes of operation, as exemplified by the coating devices of U.S. Pat. Nos. 3,257,226, 3,029,780, and 3,951,102. These known coaters however are not noteworthy in their effectiveness and, most important, are not compatible with the operation of a standard offset printing press, to which the within invention is applied, as distinguished from a so-called web press. That is, the known coaters are restricted to use with said web press in which a continuous web is fed through the press and a significant degree of tension can therefore be exerted on the web as it is being printed. This ability to apply tension to a continuous web greatly facilitates the application of a coating thereto, whereas applying the same degree of tension to individually fed sheets of an offset printing press, an operating parameter which usually is required during the coating of the individul sheets, may inadvertently cause disengagement of the individual sheet from the grippers and thus seriously adversely affect the printing operation of the standard offset printing press.

Broadly, it is an object of the present invention to provide a coater for an offset printing press handling individually fed sheets overcoming the foregoing and other shortcomings of the prior art. More particularly, it is an object to utilize to advantage the sheet-handling apparatus of the printing press and to combine therewith a surface coating means, so that coating is effectively applied to the imprinted sheets while they are under the handling control of the printing press.

A coater demonstrating objects and advantages of the present invention is applied to a printing press of the type in which individual sheets are imprinted during passage through a nip between a cooperating blanket cylinder roller and an impression cylinder, said nip defining each of plural printing stations operatively arranged in series relation with each other. More particularly, the coater includes an operational mode that contemplates using the last encountered blanket cylinder roller for coating service, rather than printing, and operatively arranging same for counterclockwise direction rotation. Located adjacent the blanket cylinder roller is a storage container for a supply of a liquid coating to be applied to the individually printed sheets having a pick-up roller disposed with a lower portion in the liquid coating supply and operatively arranged for counterclockwise rotation for moving the liquid coating adhered to the surface thereof through an ascending arcuate path of less than 180 degrees, this restricted path being effective to obviate reverse direction flow of said liquid coating along said pick-up roller surface. Completing the rotating components is an applicator roller operatively arranged in contact with the pick-up roller along said arcuate path and also in contact with the blanket cylinder roller, said applicator roller being operatively arranged for clockwise rotation for maximizing the amount of liquid coating transferred thereto from the counterclockwise rotating pick-up roller at the respective surfaces of each which are either in light surface contact with each other or slightly spaced apart. In this way the imprinted sheets are individually coated during passage between the opposite direction rotating applicator and blanket cylinder rollers, said liquid coating serving as a lubricant permitting said opposing direction movements in said applicator and blanket cylinder rollers.

The above brief description, as well as further objects, features and advantages of the present invention, will be more fully appreciated by reference to the following detailed description of presently preferred, but nonetheless illustrative embodiments in accordance with the present invention, when taken in conjunction with the accompanying drawings, wherein.

Figure 2:
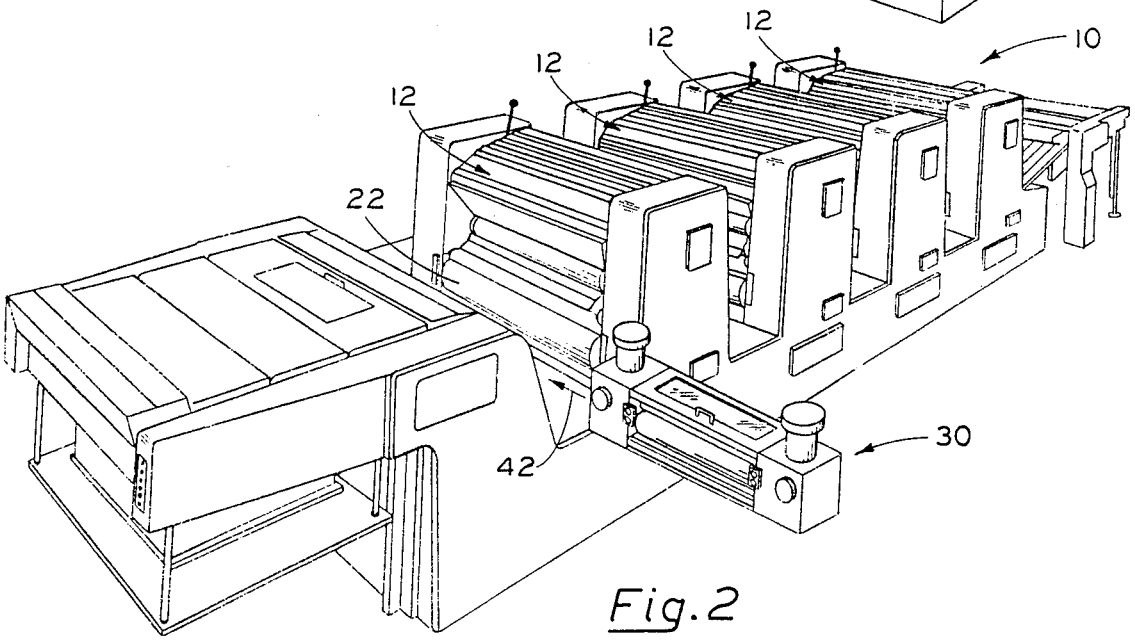
FIG. 2 is also a perspective view and illustrates how the coating device of FIG. 1 is moved into its operative position with the blanket cylinder roller of said printing press.
Figure 3:
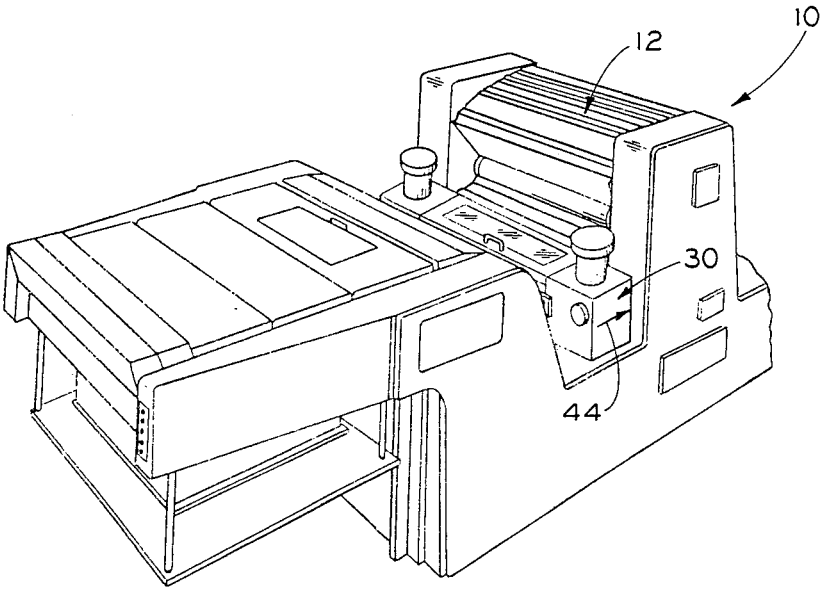
FIG. 3 is a partial perspective view illustrating the operative position of said coating device at a printing station of said printing press.

Illustrated in FIG. 2 and partially in FIG. 3, will be understood to be a standard sheet fed offset printing press, generally designated 10. As is well understood, said standard offset printing press 10 includes plural printing stations, individually and collectively designated 12, at which a separate color is transferred to individual sheets providing a multi-color result. More particularly, and as will be explained in greater detail subsequently, on multi-color presses of which the printing press 10 will be understood to be an example, the transferring of a sheet from one printing station 12 to the next printing station located in line therewith, while keeping said sheet in exact register, is accomplished by means of transfer cylinders whose grippers are timed to take hold of the sheet before they are released by the previous cylinder gripper. For purposes of the within invention, it is important to note that the aforesaid operation of a standard offset printing press differs significantly from a so-called web press, in which a continuous web is fed through the press and a significant degree of tension can therefore be exerted on the web as it is being printed. This ability to apply tension to a continuous web greatly facilitates the application of a coating thereto, whereas applying the same degree of tension to individually fed sheets of an offset printing press, an operating parameter which usually is required during the coating on the individual sheets, may inadvertently cause disengagement of the individual sheet from the grippers and thus seriously adversely affect the printing operation of the standard offset printing press.

Figure 4:
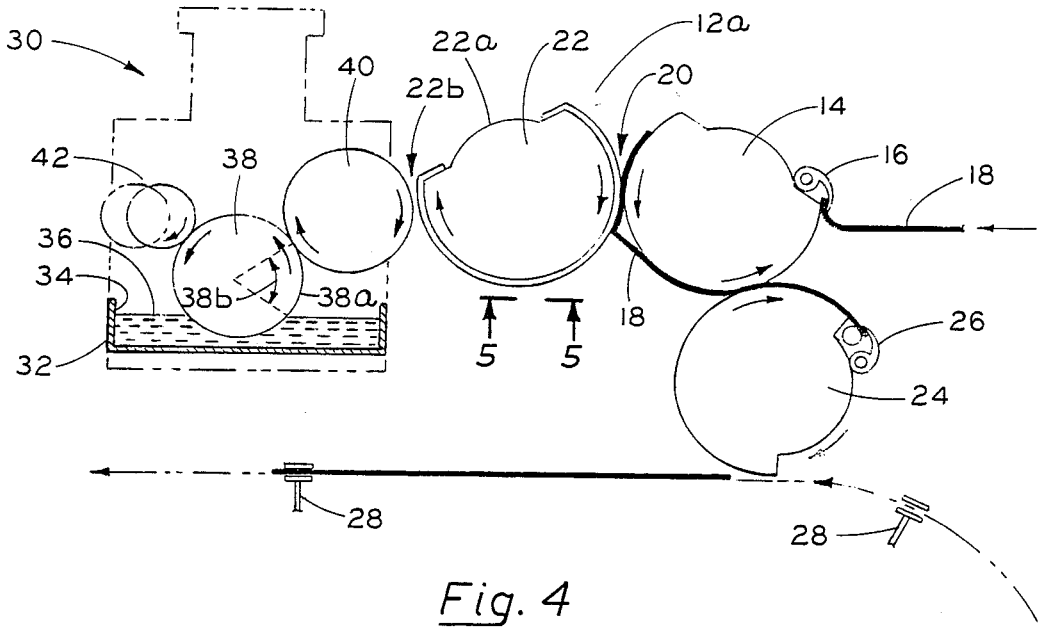
FIG. 4 is a simplified side elevational view in longitudinal cross section illustrating structural details of the printing press and coating-applying cooperating rollers of the within invention.

An important contribution of the present invention therefore is the achievement of applying a coating to individually fed sheets of a standard offset printing press, such as press 10, without adversely affecting the printing operation of said press The manner in which, in accordance with the present invention, individual fed sheets of an offset printing press are effectively coated, can best be appreciated by the simplified cross sectional view of FIG. 4, to which figure reference should now be made. In accordance with the present invention, the last encountered printing station 12, designated 12*a* in FIG. 4, is incorporated as part of the within inventive coating operation. Printing station 12*a*, as is well understood, is defined by an impression cylinder 14 having standard cnstructed and operating grippers 16 which effectively grip, in turn, the leading edge of each imprinted sheet 18. Rotation of the impression cylinder 14 carries the gripped sheet 18 to the nip 20 of said impression cylinder 14 and a cooperating blanket cylinder 22. When used for printing, the blanket cylinder 22 prior to the nip 20 receives an ink image from a printing plate (not shown) and effectively transfers this ink image to the sheet 18. In accordance with the present invention, however, the blanket cylinder 22 is not used for printing service, but is used for effectively applying a liquid coating to the individually fed sheets 18, said coating typically being an appropriate chemical for blocking adverse effects of ultra-violet rays or other aqueous coating, or may even be an acrylic water based coating to provide a gloss or otherwise enhance the appearance of the imprinted sheet. The coating may also accelerate the drying of the printing ink applied to the sheet.

Before describing how the liquid coating is applied, it is helpful to complete the description of the operation of the components of the printing press at station 12*a*. This operation is completed by a transfer cylinder 24 having grippers 26 which in a well understood manner engage the sheet 18 as it exits from the nip 20 and effectively transfers each sheet 18 to sheet-gripping devices 28 of a conveyor which delivers each sheet to a point of discharge.

Thus far what has been described, except for the use at station 12*a* of the blanket cylinder 22 for coating rather than printing service, is well understood and does not form an essential part of the within invention. The contribution of the within invention, which will now be described, consists of the coating device, shown in isolated perspective in FIG. 1 and generally designated 30 therein, which cooperates with and has an operative position in relation to the blanket cylinder 22, as shown in FIGS. 2, 3, and as now will be described in detail.

Still referring to FIG. 4, the coating device 30 includes a housing 32 which bounds a compartment 34 for the storage of a supply of the liquid coating 36 to be applied to the individual fed sheets 18. Appropriately journaled for rotation in the lower portion of the supply 36 is a pickup roller 38, which, because the blanket cylinder roller 22 is journaled for rotation in a clockwise direction, is itself journaled for rotation in a counterclockwise direction, the reasons for which different directions of rotation will soon be apparent. During counterclockwise rotation of the pickup roller 38, however, a liquid coating which adheres to its surface is raised through an ascending path 38*a* and is transferred therefrom before the path 38*a* is as long as 180 degrees. As a result, a liquid which is picked up on the surface of the pickup roller 38 does not travel through an arcuate path of such length that there is reverse flow (i.e., flow in a direction which is opposite the rotational direction of roller 38) in the picked-up liquid coating. Rather, at a point of ascending movement which does not exceed to only 80 degrees as noted by the angle 38*b*, surface contact is established with said pickup roller 38 by an applicator roller 40 appropriately journaled for rotation in a clockwise direction. Thus, at the surface contact established with the pickup roller 38, the clockwise rotation of applicator roller 40 is in a direction which most effectively transfers a maximum amount of liquid coating from said pickup roller 38 to its surface. On the side of the applicator roller 40 opposite from the pickup roller 38, the surface of the applicator roller is located in a range from being in light contact with the surface of the blanket cylinder 22 to a slight gap 22*b* spaced therefrom. This light contact or slightly spaced apart relationship of the surfaces of the rollers 40 and 22 is necessitated by the opposing directions of rotation of these rollers. Nevertheless, it has been found in practice that the liquid coating, which may consist of the chemical sold under the trademark SUN CURE by General Printing Ink, division of Sun Chemical of New Jersey, effectively serves as a lubricant which permits the opposing directions of rotation while at the same time there is an effective transfer of the liquid coating from the surface of the applicator roller 40 the surface of the blanket cylinder 22 even, under some operating conditions, across the slight gap 22*b*. Naturally, there is no transfer in the gap area 22*a* of the blanket cylinder 22 which gap area must be provided in order to register with the gap area that has to be incorporated in the construction of the impression cylinder 14 because of the grippers 16.

Completing the construction of the coating device 30 is a metering roller 42 which in an appropriate manner is mounted for movement in a clearance position shown in phantom perspective in FIG. 4 into an operative condition shown in full line in FIG. 4, in which latter position it makes contact with the pickup roller 38. The metering roller 42 is only in contact with the pickup roller 38 when the apparatus is running in a standard mode, but said metering roller 42 is disengaged from the pickup roller 38 when the latter is running in a reverse mode (i.e., counterclockwise), thus giving the operator the option of running in either the standard or reverse mode.

Referring now to FIGS. 2 and 3, it is noted for completeness' sake that at the last encountered printing station, which, according to the present invention, is to be used for coating rather than printing service, there is exposure of and therefor ready access to the blanket cylinder 22 of this station. The coating device 30 will be understood to be on appropriate support apparatus, not shown, so that is can be effectively moved from a clearance position to the side of the printing press 10 as shown in FIG. 2, into an operative in line position in the direction 42, said operative position being more particularly illustrated in FIG. 3. In the operative position of FIG. 3 it will then be understood that preferably using pneumatic cylinders which engage the device 30 in its operative position, that said device is effectively moved in the direction 44 towards the blanket cylinder 22 so that light contact or the slight gap 22*b* is established with said blanket cylinder 22 and the previously referred to applicator roller 40 of the device 30.

Figure 1:
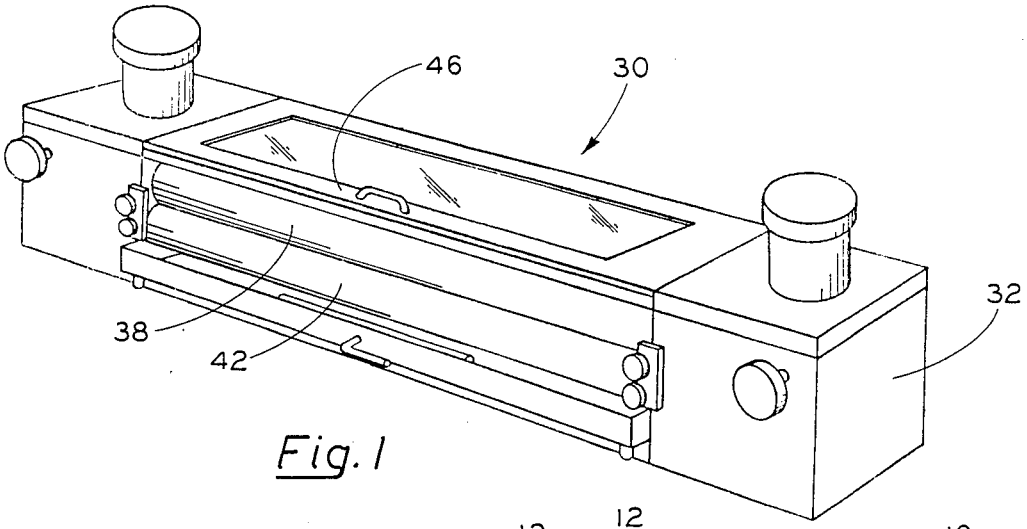
FIG. 1 is a perspective view of a coating device which, in accordance with present invention, is used in cooperating conjunction with a blanket cylinder roller of a standard offset printing press.

As is perhaps best illustrated in FIG. 1, the coating device 30 includes, in addition to the components thereof previously described, a hinged top cover 46, which when opened provides access for making any repairs or replacements to the pickup roller 38, applicator roller 40 or metering roller 42, as well as to the motor which is operatively associated with the metering roller 42 for moving it from its clearance position into contact with the pickup roller 38 and also for the motor which is operatively engaged to drive the pickup roller 38 through rotation. Access through the opening of the cover 46 to the compartment 34 is also necessary for replenishing the liquid coating supply 36.

Figure 5:
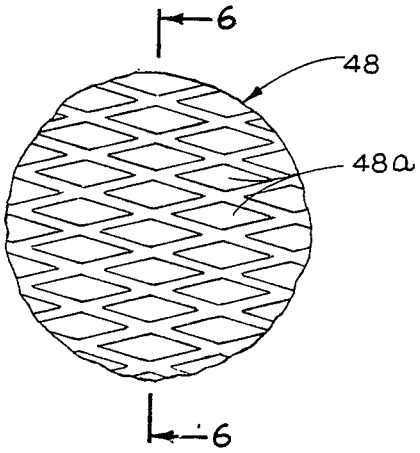
FIG. 5 is a partial view as seen along lines 5—5 of FIG. 4 illustrating, on an enlarged scale, structural details of an elastomeric blanket of the blanket cylinder roller.
Figure 6:
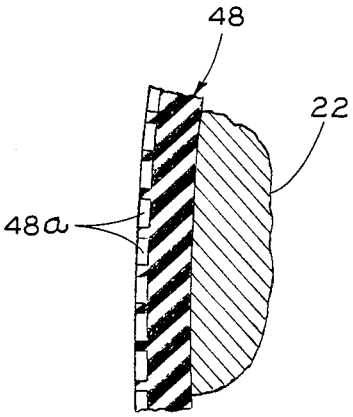
FIG. 6 is a view in cross section, taken along lines 6—6 of FIG. 5, showing further structural details of the surface of said blanket cylinder roller.

Special note is made in FIGS. 5 and 6 of a possible elastomeric blanket which is recommended for use for the blanket cylinder 22 to enhance its coating-applying efficiency. As shown in these figures, appropriately mounted about the periphery of the blanket cylinder 22 is an elastomeric blanket 48 having a pattern of surface depressions, individually and collectively designated 48*a*, which are effective in receiving acrosss the nip or gap 22*b* that previously was described as having been established between the applicator roller 40 and blanket 22, a maximum amount of the liquid coating 36 for transfer to the individual fed sheets 18 at the nip 20.

In the apparatus as illustrated and described in connection with FIGS. 2 and 3, the direction of the individual fed sheets 18 are from right to left, and thus the rotation direction of the blanket cylinders 22, including said cylinder at the coating station 12*a*, are in a clockwise direction. It should be readily appreciated, however, that if the delivery of the individually fed sheets 18 were from left to right, that the rotation direction of the blanket cylinders would be in a counterclockwise direction, and that the rotation directions of the moving components of the coating device 30 would then be in the opposite direction than that illustrated and described in connection with FIG. 4. Accordingly, it is to be understood that the within invention, and the claims defining same, contemplate both directions of rotation of the rotating components practicing said invention.

Figure 7:
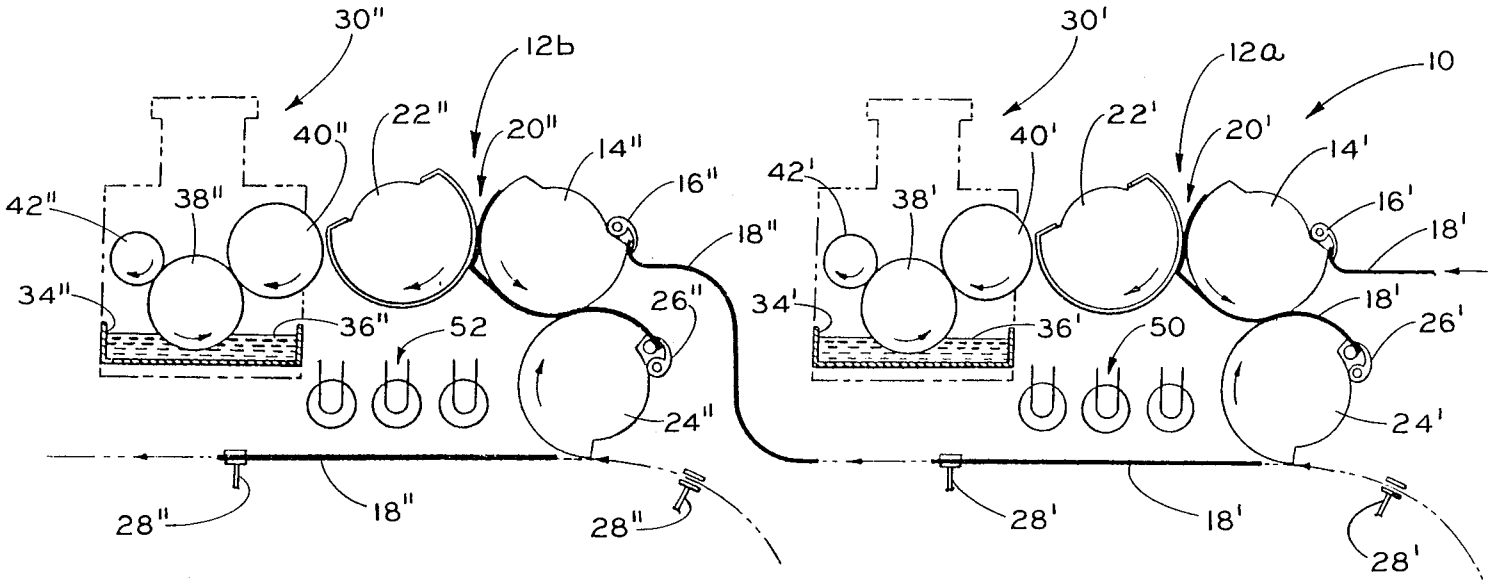
FIG. 7 is a view similar to FIG. 4, but illustrating the application of two coatings to the sheet fed material at two printing stations.

Referring now to FIG. 7, it will be further understood that the within invention contemplates applying a coating to the individual fed sheets 18 at two stations, rather than just one station, as illustrated and described in connection with FIGS. 1–6. A two-station coating process is particularly advantageous in order to achieve a high lamination appearance on the imprinted sheets 18. That is, as understood, in order to presently achieve a high gloss on an imprinted sheet, it is necessary to use a mechanical process in which a plastic film is laminated to the printed substrate. In accordance with the present invention, it is now possible to achieve such a result chemically, rather than mechanically. To do this, and as illustrated diagramatically in FIG. 7, the printing press 10 is modified to the extent of constructing an additional coating station 12*b* down the line from station 12*a* of FIG. 4. In all other respects, except as noted, the structure already described in connection with FIG. 4 is the same, and this similarity is indicated in FIG. 7 by the use of the same reference numerals with a single prime of coating station 12*a*, and a double prime at coating station 12*b*. The only structure added to the setup of FIG. 7 are infrared lamp dryers 50 and 52 located as illustrated at the coating stations 12*a* and 12*b*, respectively. The dryers 50 and 52 will be understood to be of conventional construction and mode of operation and, in lieu thereof, good results can also be achieved using convection hot air units.

Coating station 12*a* is preferred to coat the individual fed sheets 18 with an acrylic water base emulsion which is applied over the sheet 18 previously printed with an oil-based ink. Exposure of the sheet 18*a* to the infrared lamp dryers 50 achieve surface drying thereof. Previously, the drying of the aqueous or ultraviolet coating on the sheet 18*a* invariably resulted in a nominal gloss level in the printed sheet. As a result, it was standard practice to mechanically laminate a plastic film to the printed sheet to obtain a high gloss level in the surface thereof. In accordance with the system of FIG. 7, however, the mechanical lamination is eliminated and in its place there is provided in accordance with the present invention a second coating station 12*b* which preferably applies a high gloss photochemical epoxy resin coating to each individually fed sheet 18″ which is transferred from station 12*a* to station 12*b*.

From the foregoing description of the system of FIG. 7, it should be readily appreciated that the process described and illustrated achieves a high gloss appearance in the imprinted sheets 12 that is the same as that achieved by mechanical lamination of plastic film and does so in much less time and without the equipment and apparatus necessary for a mechanical lamination process. The process of FIG. 7 utilizes already existing stations of a multi-station offset standard printing press modified in the manner herein illustrated and described to provide coating, rather printing service.

In the foregoing description, the reference to imprinted sheets and the application thereto of the within inventive coating methods is intended to have specific reference to chemically achieving an ultra high gloss surface over wet ink, an achievement which in the trade would be aptly called "wet trap in line", wherein the "wet trap" signifies achieving a dried ultra high gloss surface trapping wet inks on the paper substrate, and "in line" signifies achieving same during the normal offset printing process rather than, as now done in the prior art, mechanical bonding a plastic film to the printed sheet as a plastic film to the printed sheet as a separate operation.

However, the invention is not limited to a "wet trap in line process", and it is to be further understood that a latitude of modification, change and substitution is intended in the foregoing disclosure, and in some instances some features of the invention will be employed without a corresponding use of other features. Accordingly, it is appropriate that the appended claim be construed broadly and in a manner consistent with the spirit and scope of the invention herein.

What is claimed is:

1. A coater for a printing press of the type in which individual sheets are imprinted during passage between a cooperating blanket cylinder roller and an impression cylinder defining each of plural printing stations operatively arranged in series relation with each other, said coater comprising said last encountered blanket cylinder roller used for coating service rather than printing operatively arranged for clockwise direction rotation, a storage container for a supply of a liquid coating to be applied to said individually printed sheets, a pick-up roller having a lower portion disposed in said liquid coating supply operatively arranged for counterclockwise rotation for moving said liquid coating adhered to the surface thereof through an ascending arcuate path not exceeding 80 degrees to obviate reverse direction flow of said liquid coating along said pick-up roller surface, and an applicator roller operatively arranged in contact with said pick-up roller to receive said liquid coating thereon adjacent the end of said arcuate path not exceeding 80° and also either in contact with, or spaced by a slight gap from, said blanket cylinder roller, said applicator roller being operatively arranged for clockwise rotation for maximizing the amount of liquid coating transferred thereto from said counterclockwise rotating pick-up roller at the respective surfaces of each in contact with each other and effectively further transferring said liquid coating thereon to said opposing direction moving surface of said blanket cylinder roller operatively arranged at a clearance position therefrom preparatory to said liquid coating being applied to said imprinted sheets at said last encountered printing station, said liquid coating serving as a lubricant permitting said opposing direction movements in said applicator and blanket cylinder rollers.

2. A coater for a printing press of the type in which individual sheets are imprinted during passage between a cooperating blanket cylinder roller and an impression cylinder defining each of said plural printing stations operatively arranged in series relation with each other, said coater comprising said last encountered blanket cylinder roller used for coating service rather than printing operatively arranged for counterclockwise direction rotation, a storage container for a supply of a liquid coating to be applied to said individually printed sheets, a pick-up roller having a lower portion disposed in said liquid coating supply operatively arranged for clockwise rotation for moving said liquid coating adhered to the surface thereof through an ascending arcuate path not exceeding 80 degrees to obviate reverse direction flow of said liquid coating along said pick-up roller surface, and an applicator roller operatively arranged in contact with said pick-up roller to receive said liquid coating thereon adjacent the end of said arcuate path not exceeding 80° and also either in contact with, or spaced by a slight gap from, said blanket cylinder roller, said applicator roller being opratively arranged for counterclockwise rotation for maximizing the amount of liquid coating transferred thereto from said clockwise rotating pick-up roller at the respective surfaces of each in contact with each other, and effectively further transferring said liquid coating thereof to said opposing direction moving surface of said blanket cylinder roller operatively arranged at a clearance position therefrom preparatory to said liquid coating being applied to said imprinted sheets at said last encountered printing station, said liquid coating serving as a lubricant permitting said opposing direction movements in said applicator and blanket cylinder rollers.

3. A pair of coaters for a printing press of the type in which individual sheets are imprinted during passage between a cooperating blanket cylinder roller and an impression cylinder defining each of plural printing stations operatively arranged in series relation with each other, said coaters comprising two sets of sequentially encountered blanket cylinder rollers used for coating service rather than printing operatively arranged for clockwise direction rotation, and for each said coater and its cooperating blanket cylinder roller, a storage container for a supply of a liquid coating to be applied to said individually printed sheets, a pick-up roller having a lower portion disposed in said liquid coating supply operatively arranged for counterclockwise rotation for moving said liquid coating adhered to the surface thereof through an ascending arcuate path not exceeding 80 degrees to obviate reverse direction flow of said liquid coating to receive said liquid coating thereon adjacent the end of said arcuate path not exceeding 80° and also either in contact with, or spaced by a slight gap from, said pick-up roller along said arcuate path and also in contact with said baanket cylinder roller, said applicator roller being operatively.arranged for clockwise rotation for maximizing the amount of liquid coating transferred thereto from said counterclockwise rotating pick-up roller at the respective surfaces of each in contact with each other and effectively further transferring said liquid coating thereon to said opposing direction moving surface of said blanket cylinder roller operatively arranged at a clearance position therefrom preparatory to said liquid coating being applied to said imprinted sheets at each said encountered printing station, said liquid coating serving as a lubricant permitting said opposing direction movements in said applicator and blanket cylinder rollers.

4. A pair of coaters for a printing press of the type in which individual sheets are imprinted during passage between a cooperating blanket cylinder roller and an impression cylinder defining each of plural printing stations operatively arranged in series relation with each other, said coaters comprising two sets of sequentially encountered blanket cylinder rollers used for coating service rather than printing operatively arranged for counterclockwise direction rotation, and for each said coater and its cooperating blanket cylinder roller, a storage container for a supply of a liquid coating to be applied to said individually printed sheets, a pick-up roller having a lower portion disposed in said liquid coating supply operatively arranged for clockwise rotation for moving said liquid coating adhered to the surface thereof through an ascending aruuate path not exceeding 80 degrees to obviate reverse direction flow of said liquid coating along said pick-up roller surface, and an applicator roller operatively arranged in contact with said pick-up roller to receive said liquid coating thereon adjacent the end of said arcuate path not exceeding 80° and also either in contact with, or spaced by a slight gap from, said blanket cylinder roller, said applicator roller being operatively arranged for counterclockwise rotation for maximizing the amount of liquid coating transferred thereto from said clockwise rotating pick-up roller at the respective surfaces of each in contact with each other and effectively further transferring said liquid coating thereon to said opposing direction moving surface of said blanket cylinder roller operatively arranged at a clearance position therefrom preparatory to said liquid coating being applied to said imprinted sheets to each said encountered printing station, said liquid coating serving as a lubricant permitting said opposing direction movements in said applicator and blanket cylinder rollers.

* * * * *